United States Patent [19]

Koga

[11] Patent Number: 5,017,967

[45] Date of Patent: May 21, 1991

[54] METHOD AND APPARATUS FOR FORMING IMAGES INCLUDING A TONER TRANSPORTING MEMBER HAVING AN INSULATING LAYER

[75] Inventor: Yoshiro Koga, Nagano, Japan

[73] Assignee: Seiko Epson Corporation, Nagano, Japan

[21] Appl. No.: 336,368

[22] Filed: Apr. 11, 1989

[30] Foreign Application Priority Data

Apr. 13, 1988 [JP] Japan ..... 63-91000
May 9, 1988 [JP] Japan ..... 63-111915

[51] Int. Cl.[5] ..... G03G 15/08

[52] U.S. Cl. ..... 355/261; 355/253; 355/259; 355/246; 355/265

[58] Field of Search ..... 355/261, 265, 262, 253, 355/259, 246; 118/647, 651; 430/120

[56] References Cited

U.S. PATENT DOCUMENTS 3,957,510 5/1976 Hermanson ..... 355/261 X
4,194,830 3/1980 Ohnuma et al. ..... 355/261 X
4,422,749 12/1983 Hoshino et al. ..... 355/261 X
4,537,491 8/1985 Komada et al. ..... 355/261 X
4,620,783 11/1986 Tanaka et al. ..... 355/245 X
4,624,559 11/1986 Haneda et al. ..... 355/261 X
4,637,708 1/1987 Yuasa ..... 355/245 X
4,755,847 7/1988 Matsushiro et al. ..... 355/261 X
4,764,841 8/1988 Brewington et al. ..... 355/261 X
4,766,460 8/1988 Yamamoto et al. ..... 355/261

*Primary Examiner*—Arthur C. Prescott
*Attorney, Agent, or Firm*—Blum Kaplan

[57] ABSTRACT

A photoconductive image forming method and apparatus in which a latent image is formed on an image forming substrate. A one component toner is charged and an electrostatic force adheres the toner to a toner transporting device. The toner is carried and transferred to the image forming substrate by a toner transporting device and the picture image is transferred to a medium. Conductive members adjacent the toner transporting device control the thickness of the toner thereon and cooperate to charge the toner. In an alternate embodiment, more than one toner transporting device each containing a colored toner is used. A multicolored image is formed by transferring each color individually to the medium.

32 Claims, 5 Drawing Sheets

METHOD AND APPARATUS FOR FORMING IMAGES INCLUDING A TONER TRANSPORTING MEMBER HAVING AN INSULATING LAYER

BACKGROUND OF THE INVENTION

The invention relates generally to photoconductive image forming, and more particularly to photoconductive image forming utilizing a one component non-magnetic toner deposited on an image forming substrate.

There are several conventional photoconductive image forming methods. One conventional method of forming an image, the Carlson process, is disclosed in U.S. Pat. No. 2,297,691. The image is formed by adhering an insulating toner in accordance with the potential of a latent image of a latent image bearing device. The Carlson process has been improved as disclosed in U.S. Pat. Nos. 3,909,258 and 4,121,931. The one component magnetic developing method has several problems. A high positioning accuracy of each part is required to obtain a clear image. In addition, a full color image is very difficult to form since the magnetic powder of the toner is difficult to color.

Two component developing methods are disclosed in U.S. Pat. Nos. 2,618,552 and 2,846,333. Although the developing electrode effect results in a clear image, two component developing methods, however, suffer from several drawbacks. First, the density of the carrier must be carefully controlled. Additionally, the image is distorted due to the scavenging effect.

Japanese Laid-Open Patent No. 114163/82 discloses a one component non-magnetic contact developing method. This method also has shortcomings. The contact developing method causes the toner adhesion to the non-image portion to degenerate, resulting in deterioration of the picture quality. Further, the toner transporting device is expensive since it serves a special function.

Accordingly it is desirable to provide for photoconductive imaging forming which does not suffer from these shortcomings of the prior art.

SUMMARY OF THE INVENTION

Generally speaking, in accordance with the invention, image forming is provided by selectively transferring a one component non-magnetic toner corresponding to an image from a toner transporting device to an image bearing device and transferring the adhered toner to a medium.

An electrostatic latent image is formed on a photosensitive layer of an image bearing device. An electric field is applied to a one component non-magnetic toner by a voltage generating means connected to conductive members for controlling the amount of toner transported by a toner transporting device. The conductive members are preferably a rotating body and a blade member. The electrostatic image force between the toner and the toner transporting device maintains the toner on the toner transporting device and the toner is carried. The toner transporting device includes an insulating layer deposited on a conductive support cylinder. In an alternate embodiment, the insulating layer does not fully cover the ends of the cylinder. In a further embodiment, the insulating layer is thicker at the ends of the cylinder. The toner is adhered to the image bearing device adjacent to the toner transporting device and transferred to a medium to form a picture image. A gap between the toner transporting device and the image bearing device ensures the toner adheres to the image bearing device only at points at which the image is to be formed. In an alternate embodiment, more than one toner transporting device, each containing a colored toner is used. A multicolored image is formed by transferring each color individually to the medium.

Accordingly, it is an object of the invention to provide an improved image forming method and apparatus capable of forming high quality images using a one component non-magnetic toner.

Another object of the invention is to provide an improved image forming method and apparatus in which it is possible to control the amount the toner is charged, creating clear images having a high contrast ratio.

A further object of the invention is to provide an improved image forming method and apparatus capable of forming multicolored images using a one component non-magnetic toner.

Still a further object of the invention is to provide an improved image forming method and apparatus using a non-contact developing method with a small developing gap.

Yet another object of the invention is to provide an improved photoconductive image forming apparatus which is simpler and costs less than conventional apparatus.

Other objects and advantages of the invention will in part be obvious and will be in part be apparent from the specifications and drawings.

The invention accordingly comprises the several steps and the relation of one or more of such steps with respect to each of the others, and the image forming apparatus embodying features of construction, combinations of elements and arrangements of parts which are adapted to effect such steps, all as exemplified in the following detailed disclosure, and the scope of the invention will be indicated in the claims.

DESCRIPTION OF THE DRAWINGS

For a fuller understanding of the invention, reference is had to the following description taken in connection with the accompanying drawings, in which.

DESCRIPTION OF THE PREFERRED EMBODIMENTS

According to the invention, the one component non-magnetic toner is charged by applying a high electric field to the toner around an insulating layer of a toner transporting device by an electric field generating device. The electrostatic image force maintains the toner on the toner transporting device and the toner is carried. The toner is adhered to a latent image bearing device in accordance with the potential contrast of the latent image bearing device at the point where the latent image bearing device adjoins the toner transporting device. The picture image is then formed.

Figure 1:
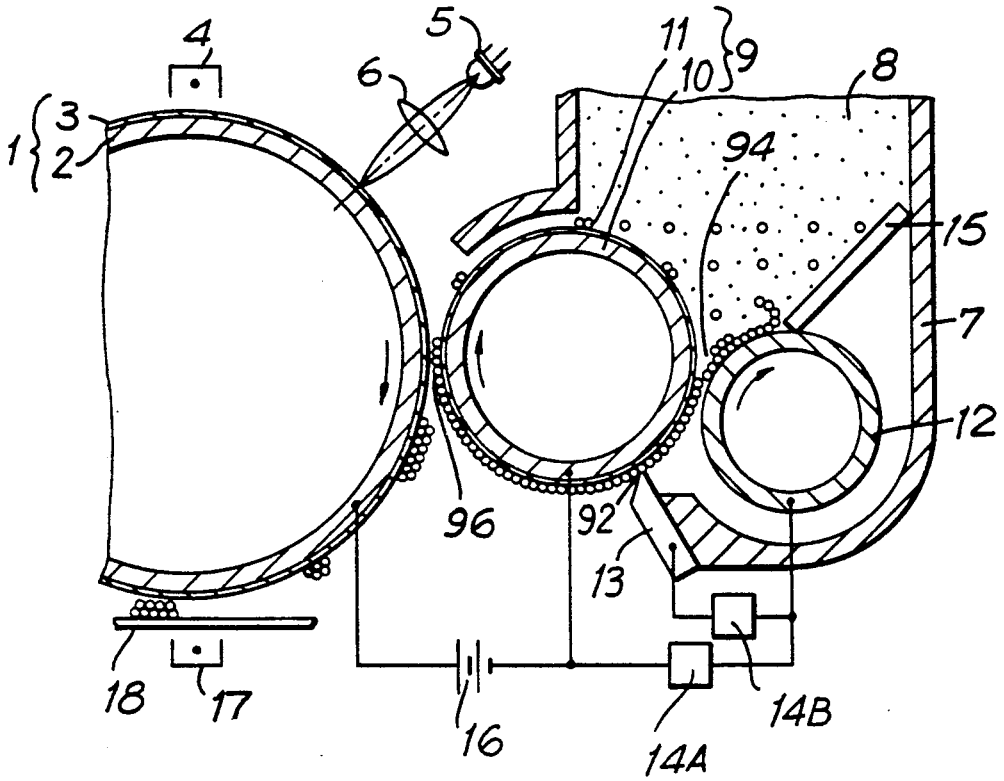
FIG. 1 is a partial cross-sectional view of an image forming apparatus constructed and arranged in accordance with the invention.

Referring now to the drawings, FIG. 1 is a sectional view of the image forming apparatus in accordance with a first embodiment of the invention. Photosensitive layer 3 is deposited on a conductive support device 2 to form a latent image bearing device 1. Photosensitive layer 3 is charged by a voltage generating device 4 to a desired potential and light from a light source 5 of, for example, a laser is scanned using a rotational polygon mirror (not shown) and applied to image formation optical system 6. An electrostatic latent image is formed on photosensitive layer 3 of latent image bearing device 1 by optical system 6.

A toner 8 for forming an image is charged by a developing device 7 and is transported by a toner transporting device 9. Toner transporting device 9 is formed by depositing a thin film insulating layer 11 on a conductive support cylinder 10. Adjacent to toner transporting device 9 is a conductive cylindrical sleeve 12 and a conductive flat shaped blade 13 for controlling the amount of toner 8 transported.

Voltage applying devices 14A and 14B are respectively connected between conductive support cylinder 10 and sleeve 12 and between conductive support cylinder 10 and blade 13. Voltage applying devices 14A and 14B generates a high electric field in a gap 92 between conductive support cylinder 10 and blade 13 and in a gap 94 between conductive support cylinder 10 and sleeve 12.

Toner 8 is charged to the desired amount of charge by injecting the charge from sleeve 12 and blade 13. As toner 8 is charged, the insulating resistance of the toner deteriorates. In order to prevent aggregation of toner 8 in gap 92 and gap 94 and to prevent gaps 92 and 94 from becoming clogged, a scraper 15 separates toner 8 adhered to sleeve 12.

Toner 8 is passed through sleeve 12 and blade 13 and obstains the charge necessary to adhere the toner to toner transporting means 9 the electrostatic image force. Toner 8 is transported by toner transporting device 9 to a developing gap portion 96, the portion where latent image bearing device 1 adjoins toner transporting device 9. To generate a developing electric field in accordance with the potential contrast of the electrostatic latent image of latent image bearing device 1, a bias voltage is applied between support device 2 and conductive support cylinder 10 by a developing bias supply device 16. Thus, charged toner 8 is dispersed toward the electrostatic latent image of latent image bearing device 1 and is adhered in accordance with the potential contrast of latent image bearing device 1 and a latent image is developed.

Toner 8 is adhered on latent image bearing device 1 and is electrostaticly transferred to record paper 18 by transfer device 17. The transferred toner 8 is fixed on record paper 18 by applying pressure and heat. Thus, the desired picture image is obtained.

If the potential of support device 2 of latent image bearing device 1 is 0V, the potential of conductive support cylinder 10 is −300V, the potential of sleeve 12 is −900V, and the potential of blade 13 is −900V ~ −1200V. It is possible to form a high contrast and high gray scale density toner image if gap 96 between latent image bearing device 1 and toner transporting device 9 is 0.2 mm, gap 94 between toner transporting device 9 and sleeve 12 is 0.3 mm, and gap 92 between toner transporting device 9 and blade 13 is 0.15 mm. If a semiconductor laser is used as light source 5, it is possible to form an excellent image with high resolution and a high gray scale property and area.

In FIG. 1, the arrows indicate the direction each member rotates. The invention, however, is not limited to an image forming apparatus having elements which rotate in the directions depicted. Additionally, the method of constructing the photosensitive layer of latent image bearing device 1 is not restricted to that shown in FIG. 1.

Figure 2:
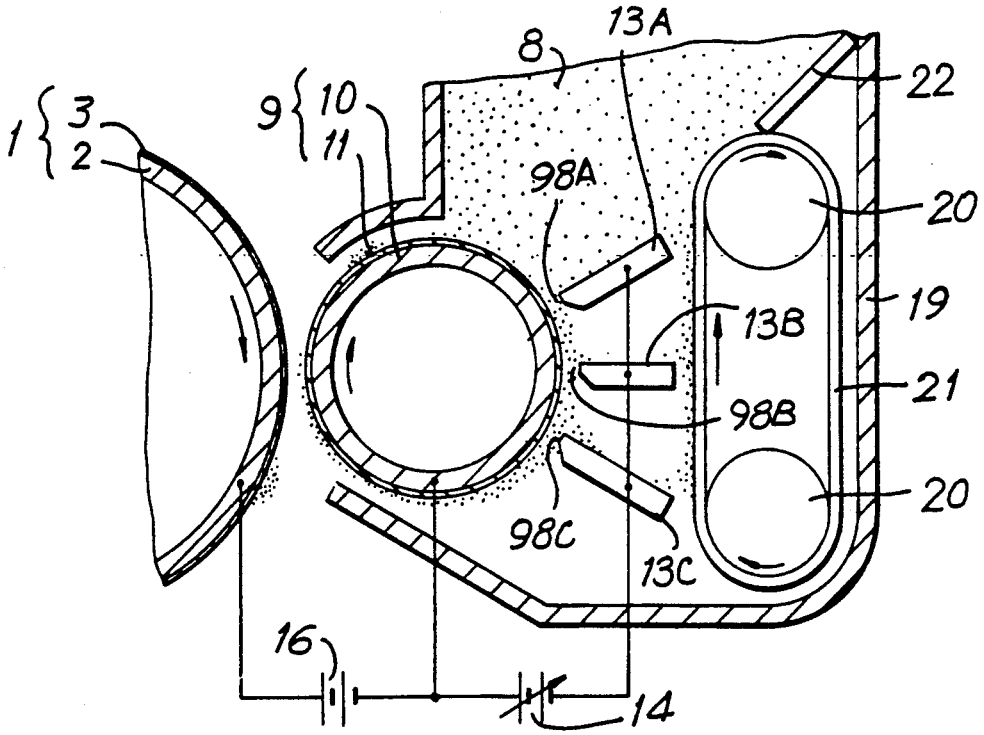
FIG. 2 is a partial cross-sectional view of an image forming apparatus constructed and arranged in accordance with an alterate embodiment of the invention.

FIG. 2 is a sectional view of an image forming apparatus in accordance with an alternate embodiment of the invention. Like reference numerals are utilized to denote like elements and features discussed above. A plurality of conductive flat shaped blades 13A, 13B and 13C control the amount of toner 8 transported. Each blade 13A, 13B and 13C is connected to conductive support cylinder 10 through voltage applying device 14. To smoothly control the amount of toner transported, gaps 98A, 98B and 98C between blades 13A, 13B and 13C respectively and toner transporting device 9 narrows towards the bottom of developing device 19. If each blade 13 has the same voltage, a higher electric field can be obtained in the gap 98C. Thus, the amount of charge injected into toner 8 is higher in degree and the amount of charge maintained by toner 8 is controlled so that it is uniform.

Toner 8, controlled by blades 13A, 13B and 13C, is transported to its original position by a transporting belt 21 and is separated from the belt by a remover 22. Toner 8 is supplied again to ga 98 between blade 13 and toner transporting device 9 by transporting belt 21. Toner 8 is transported by transporting belt 21 regardless of the material used for transporting belt 21. An electric field may also be applied to increase the adhesivity of toner 8 to transporting belt 21 and to make it easier to separate toner 8 at remover 22. Although other devices for transporting the toner to toner transporting device 9 may be used, transporting belt 21 prevents the unwanted accumulation of toner 8, the clogging of toner 8 and the unwanted conditions.

Figure 8:
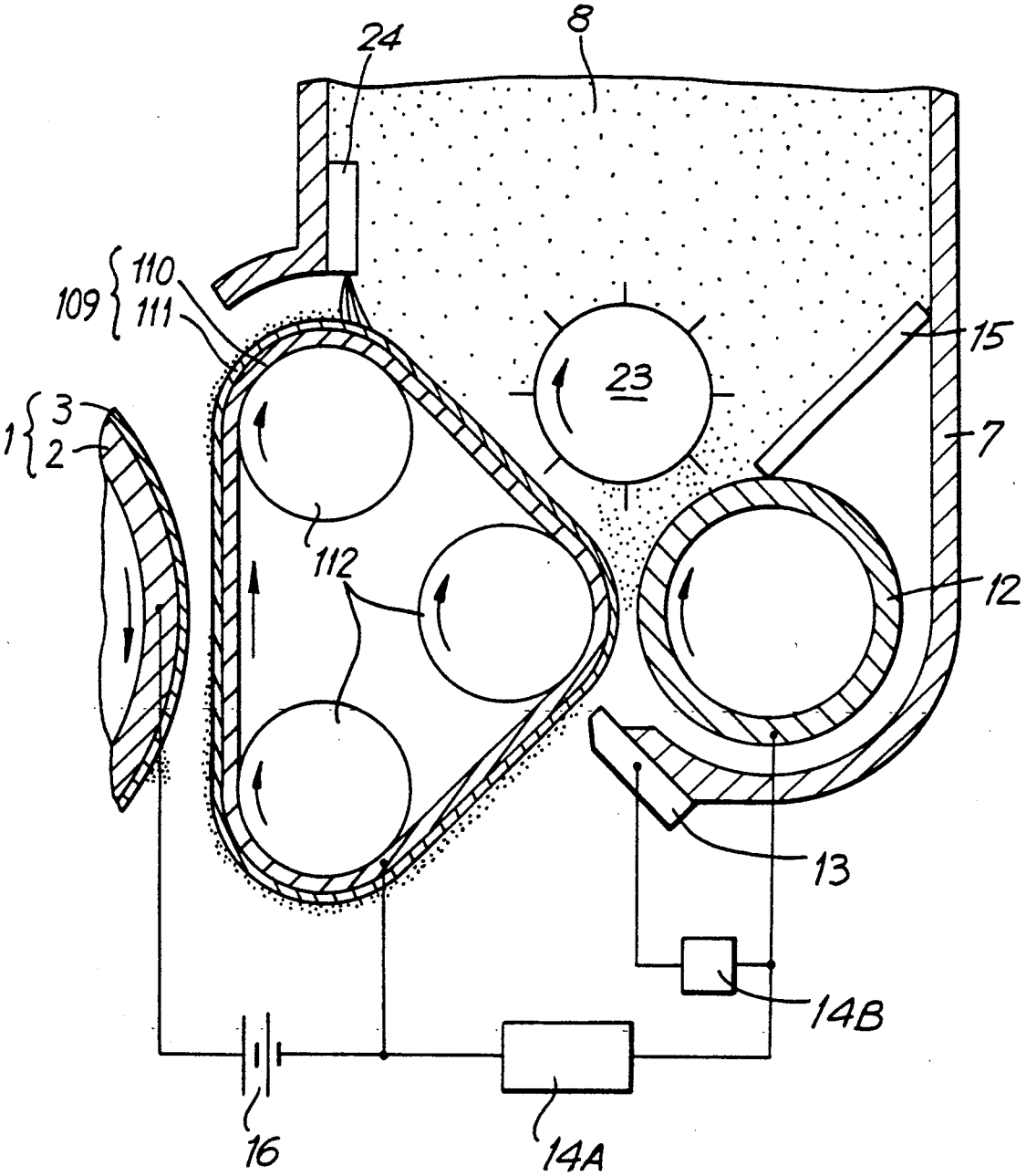
FIG. 8 is a partial cross-sectional view of an image forming apparatus constructed and arranged in accordance with a still another alternate embodiment of the invention.

In FIGS. 1 and 2, sleeve 12 and blades 13 control the amount of toner transported to latent image bearing device 1 and prevent toner 8 from splashing. A plurality of such devices are provided. A toner stirring device 23 (see: FIG. 8) is provided above sleeve 12 and blades 13 and prevents clogging of toner 8 in the gaps between sleeve 13 and blades 13 on the one hand and toner transporting device 9 on the other hand.

A device for removing electrical charge 24 (see: FIG. 8) from insulating layer 11 of toner transporting device 9 is provided above blades 13 to remove the danger of possible electrical discharge resulting from an excess charge of insulating layer 11 and to maintain stable charge of toner 8. The amount of electrical charge injected into toner 8 is controlled by changing the length of the gap between blade 13 and toner transporting device 9 and by changing the applied voltage.

The toner removing members including scraper 15 and remover 22 are provided adjacent to blade 13. Scraper 15 and remover 22 prevent the accumulation of toner 8 in order to maintain a stable supply of toner 8.

Non-contact type developing is also possible since thickness of toner 8 on toner transporting device 9 can be thin. If toner 8 has two to five layers, a clear picture image is obtained without the special developing electrode effect. If the developing gap has a small value of between about 100 to 200 μm.

Toner transporting device 9 can have a cylindrical shape and be in the form of an endless belt. Additionally, to obtain a stable charge of toner 8, insulating layer 11 of toner transporting device 9 can be a resin having high insulating properties, including polyethylene terephthalate, polycarbonate, polysulfon, tetrafluoroethylene or nylon. Depending upon the insulating properties and the durability of the material selected, an insulating layer 11 of less than 100 μm is adequate.

FIG. 8 is a partial cross-sectional view of an image forming apparatus constructed and arranged in accordance with a still another alternate embodiment of the invention. Like reference numerals are utilized to denote like elements and features discussed above. Toner transporting device 109 is in the form of an endless belt and is formed by depositing a thin film insulating layer 111 on a conductive support belt 110. A plurality of rollers 112 for moving the toner transporting device 109 are provided inside the toner transporting device 109. Adjacent to toner transporting device 109 is a conductive cylindrical sleeve 12 and a conductive flat shaped blade 13 for controlling the amount of toner 8 transported.

Figure 3:
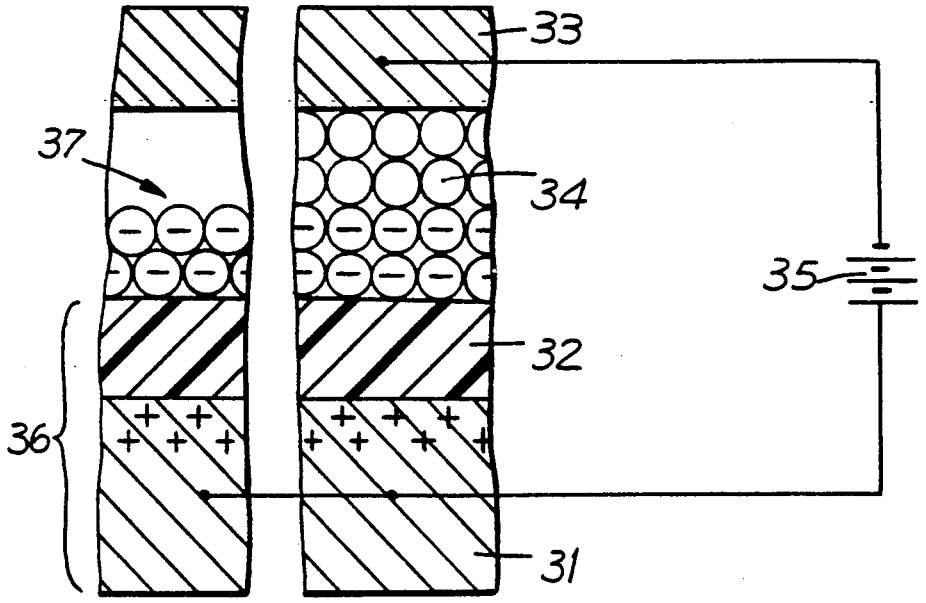
FIG. 3 is an enlarged partial cross-sectional view of the image forming apparatus constructed and arranged in accordance with the invention showing the method of the toner charge at the toner transporting device.

FIG. 3 is a partial cross-sectional view of the image forming apparatus in accordance with the invention showing the principle of toner charge. An insulating layer 32 is formed on a conductive support device 31. A toner transport control member 33, corresponding to sleeve 12 and/or blades 13, which controls the amount of toner transported, is provided a specified distance from insulating layer 32 on conductive support device 31. An electric field generating device 35 is connected between conductive support device 31 and toner transport control member 33.

Toner 34 is supplied to the gap between toner transport control member 33 and insulating layer 32 and the amount of toner 34 is controlled by toner transport control member 33. Toner 34, on the surface of insulating layer 32, is injected with charge by toner transport control member 33 by an induced polarization effect caused by the high electric field of insulating layer 32 and/or a lowering effect of the insulating resistance of toner 34 when exposed to a high electric field. Toner 34 is thus charged.

Charged toner 3 is adhered to toner transporting device 36 through an electrostatic image-force. Even in condition 37 which corresponds to the left half portion of FIG. 3, wherein an electric field is not applied from the external portion and which does not contain toner transport control member 33 for controlling the amount of toner transported, toner 34 does not loose the adhesive force.

Toner 34 is transported by toner transporting device 36 When toner 34 reaches the developing gap, the gap between toner transporting device 9 and latent image bearing device 1, the toner image is formed on latent image bearing device 1 in accordance with the potential contrast of the electrostatic latent image.

Figure 4:
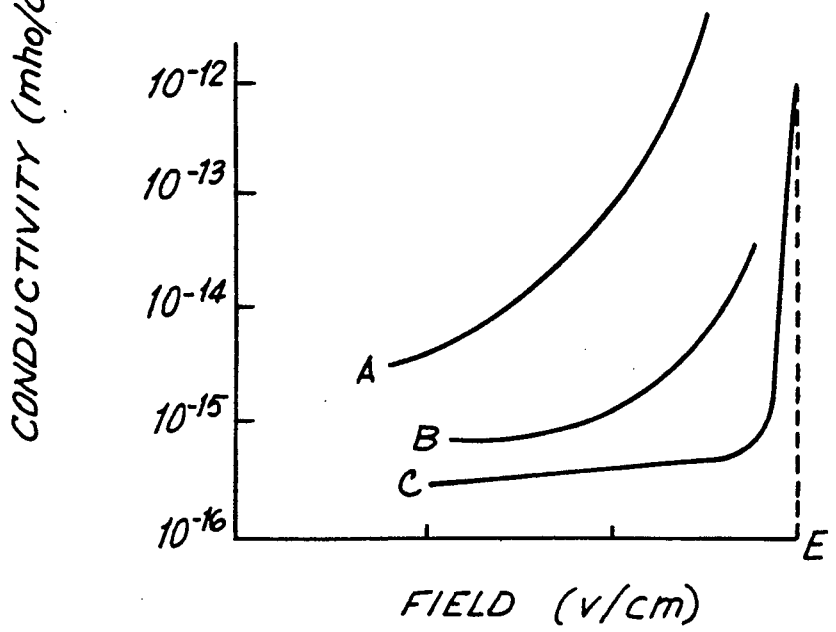
FIG. 4 shows the relationship between conductivity of the toner and the electric field strength.

FIG. 4 shows the relationship between conductivity of the toner to electric field strength of the toner. Toners A and B have insulating properties, however, these toners show behavior close to toners having high conductivity properties. With toners A and B a sufficient amount of toner charge is obtained when the electric field strength is 10 kV/cm. Although toner C also has insulating properties, the conductivity of toner C becomes high, as indicated with the broken line, as the electric field strength nears E. When the electric field strength is between about 10 kV/cm to 100 kV/cm a sufficient amount of toner charge is obtained.

FIG. 4 shows the range of electric field strength for the toners is the range in which the toner does not irreversibly break down and the range in which the insulating layer on the toner transporting device does not cause the toner to break down. Either resin series or wax series can be used as the toner material. The toner is also not limited to non-magnetic toners. It also possible to use the method for forming an image in accordance with the invention with a magnetic toner. Thus, an image can be formed with various kinds of toner.

Figure 5:
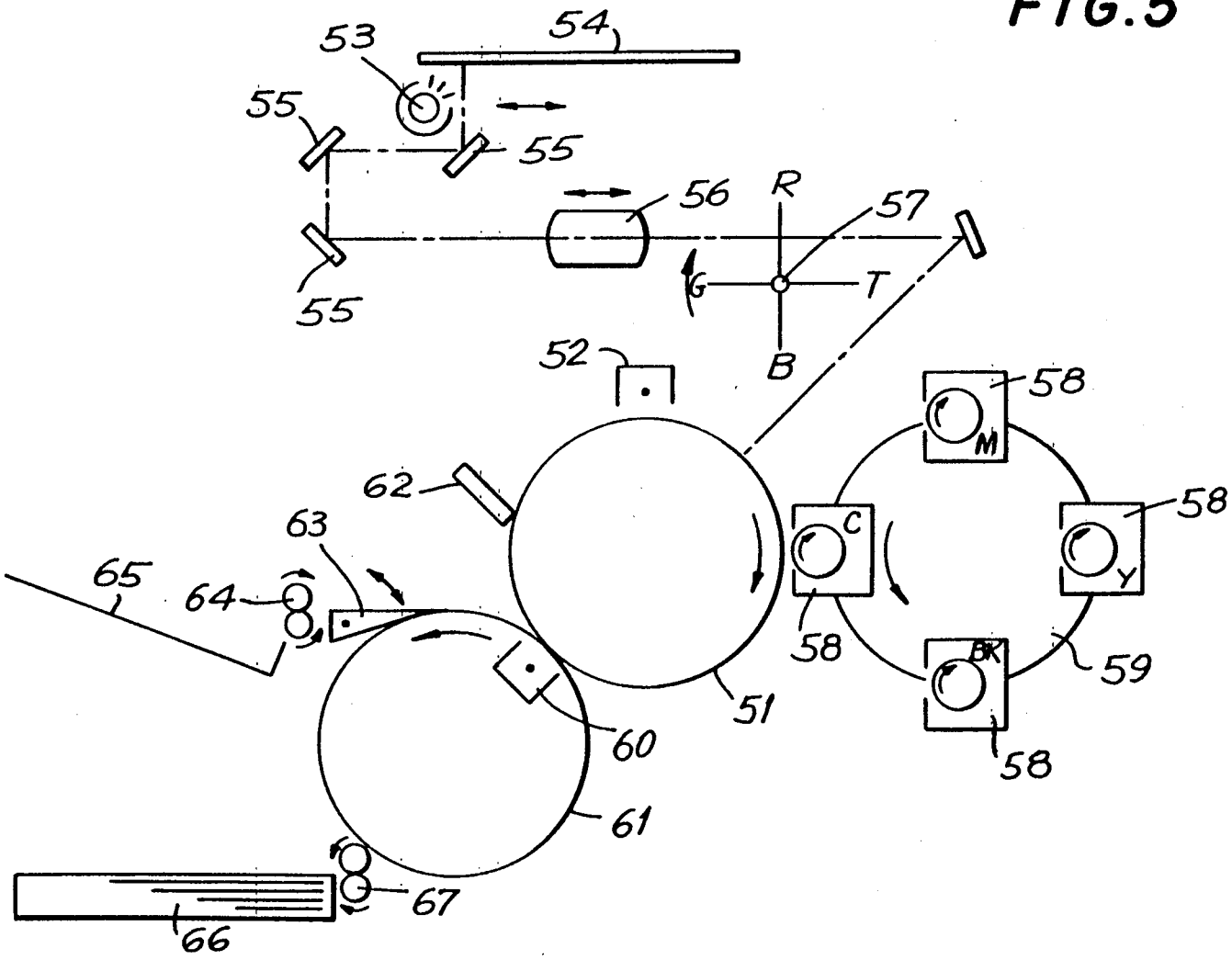
FIG. 5 is a partial cross-sectional view of a image forming apparatus constructed and arranged in accordance with another alternate embodiment of the invention.

FIG. 5 is a sectional view of the image forming apparatus of a third embodiment in accordance with the invention for forming a multicolored image. A latent image bearing device 51 is charged to a desired potential by a charging device 52. Paper 54, including an image to be copied, is exposed by a light source 53 and the resultant reflected light is reflected by a plurality of mirrors 55 and the light is passed through a lens 56. The reflected light passes through a selected one of color filters 57, which includes a plurality of colors, to expose a latent image bearing device 51. A developing unit 59 consisting of four color developing devices 58 forms a toner image in accordance with the potential contrast obtained on latent image bearing device 51.

Transfer device 60 transfers the toner image on latent image bearing device 51 to a sheet of paper wound around a transfer drum 61. The toner not transferred on latent image bearing device 51 is removed by a cleaning device 62 and the electric charge of latent image bearing device 51 is neutralized. The same process is repeated as color filters 57 are rotated to change the color of the filter and developing unit 59 is simultaneously rotated to present a new color developing device 58 to change the color of the toner. Peeling stop 63 separates the printed paper from transfer drum 61 after all of the colors of the toner are transferred to the printed paper. The image produced by the different color toners is fixed by a fixing device. The paper is transferred to a paper collection tray 65. At least one set of paper feeding rollers 67 supplies the next sheet of paper to be printed to transfer drum 61 and the color images are transferred one by one.

In FIG. 5, the arrows indicate the direction of rotation of each part. The symbols R, G, B and T of color filter 57 indicate the color of the transmitted light of each filter as red, green, blue and all colors, respectively. The symbols C, M, Y and Bk indicate the color of the toner in each color developing device 58 of developing unit 59 as cyan, magenta, yellow and black, respectively.

When a monochrome manuscript or similar document is copied using the image forming apparatus in accordance with the invention, the developing device 58 containing black toner is used. When it is necessary, however, to reproduce a full color image including a color photograph, developing unit 59 having at least the colors cyan, magenta and yellow are used for developing devices 58, or developing unit 5 having all colors is used to obtain the color image.

Figure 6:
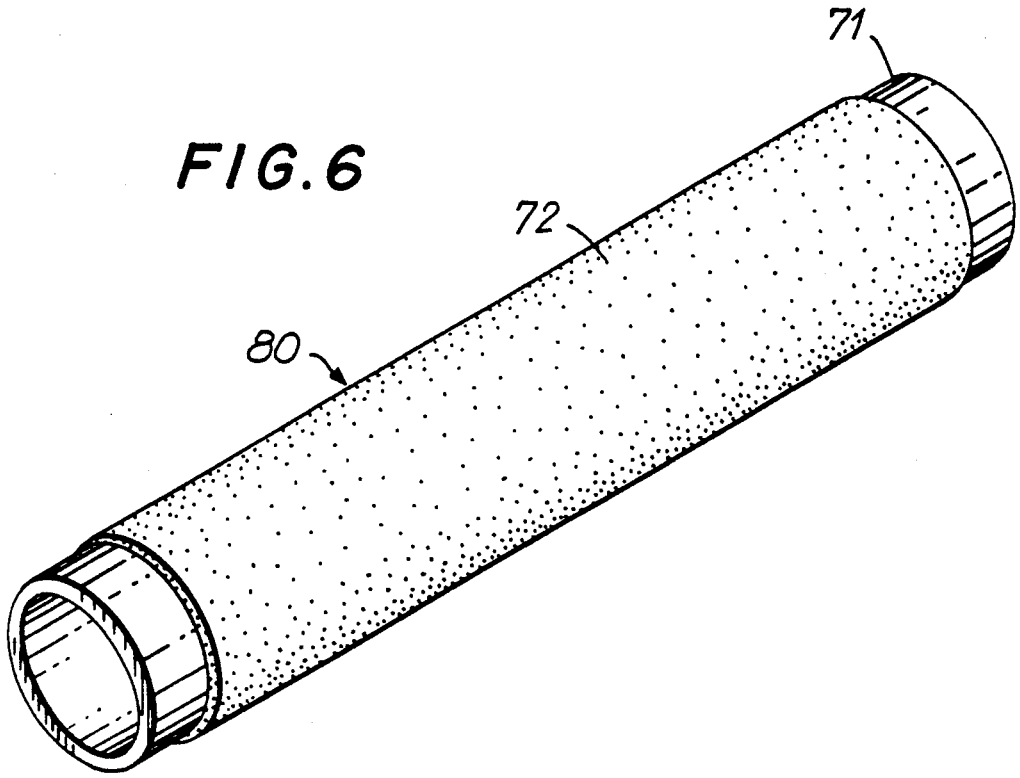
FIG. 6 is a perspective view of a toner transporting device constructed and arranged in accordance with one embodiment of the invention.

FIG. 6 is a perspective view of a toner transporting device in accordance with another embodiment of the invention. Toner transporting device 80 includes an insulating layer 72 formed on a conductive cylindrical support device 71. Insulating layer 72 does not completely cover conductive cylindrical support device 71. Rather, both ends of conductive support device 71 are exposed. Insulating layer 72 is preferably less than about 100 μm thick. The unexposed ends of conductive support device 71 serve as a reference position for the finishing process after forming insulating layer 72. Thus, the electric field for the developing process can be made uniform since it is possible to make insulating layer 72 a uniform thickness.

Figure 7:
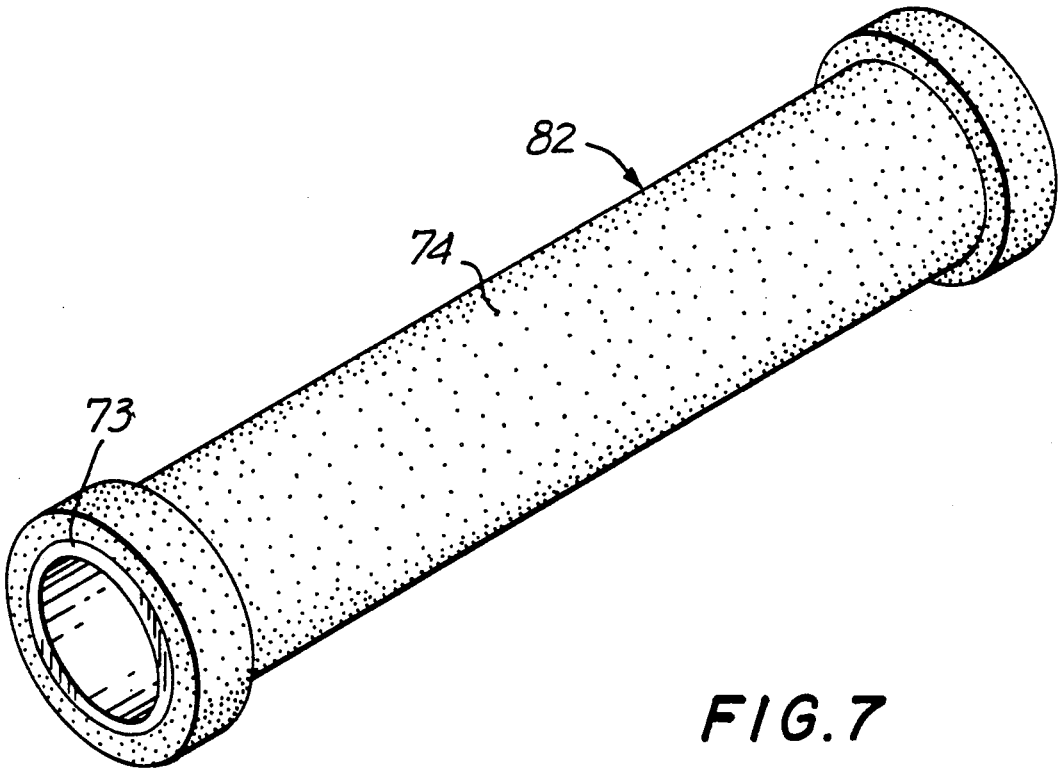
FIG. 7 is a perspective view of a toner transporting device constructed and arranged in accordance with a further embodiment of the invention.

FIG. 7 is a perspective view of a toner transporting device in accordance with a still further embodiment of the invention. Insulating layer 74 is deposited on conductive cylindrical support device 73. A convex portion of insulating layer 74 is formed at both ends of conductive support device 73 and a thin film is formed in the central portion of conductive support device 73. Insulating layer 74 is preferably about 20 μm thick in the central portion of conductive support device 73 and preferably about 220 μm thick in the convex portion at the ends of conductive support device 73. In accordance with the structure of the toner transporting device of FIG. 7, a uniform developing electric field is obtained by contacting the convex portions of insulating layer 74 at the ends of conductive support device 73 with the latent image bearing device so that a developing gap of approximately 200 μm is achieved.

In the embodiments depicted in FIGS. 6 and 7, a low cost insulating layer with high insulating properties and a resistivity greater than $10^{12}\Omega$cm may be obtained if insulating layers 72 and 74 are formed of a resin including polystyrene, acrylic, phenol, polyester, silicon elastomer, polyurethane, epoxy resin, polyimide, cellulose or natural rubber. If the insulating layer is formed of a photoconductive material including selenium, zinc oxide, titanium oxide, cadmium sulfide or an organic photoconductor, the electrical charges of the insulating layer are discharged by light irradiation. Thus, uniform discharge of electrical charges is achieved by a simple structure. Thus, the problems associated with the conventional methods of photoconductive image forming are solved and electrical charges may be uniformly discharged with a developing apparatus that has a simple structure. Conductive support devices 71 and 73 are formed of a conductive material including iron, stainless steel, copper, aluminum and other conductive materials capable of low-cost machining. Thus, a high quality device is formed at low cost.

There are several methods of adhering the insulating layer to the conductive support device with a high degree of accuracy. First a contacting layer is deposited on the conductive support device and the insulating layer is deposited thereon. Second, a finishing process (machining process to smooth the surface of the insulating layer) is performed after the insulating layer is formed by injection. Third, the conductive support device is placed in a solvent including the insulating layer.

Since it is unnecessary in the method and apparatus in accordance with the invention to use magnetic powder and electrically conductive powder as the material for the toner it is easy to color the toner and full color imaging is possible. Further, image forming having small differences in density can be achieved since it is possible to control both the charge of the toner and the amount of toner transported by the toner transporting device. Thus, only toner having the desired charge is transported as a thin film to the developing portion.

In addition, the toner transporting device is formed by a simple process in which a resin, which serves as an insulating layer, is deposited on a cylindrical conductive support device. Since the finishing process is also very simple, it is possible to make the insulating layer a uniform thickness. The developing gap may be set using both ends of the toner transporting device to make the developing electrical field uniform, preventing a difference in the amount of developing toner.

The photoconductive image forming apparatus in accordance with the invention is not restricted to the embodiments described above. For example, the invention may be used for an electrophotographic recording apparatus. In particular, it is effective to employ the image forming apparatus of the invention, using a non-magnetic one component toner, in a full color printer or duplicator for copying pictures and photographs, in a video recorder for recording images from television and in a monochrome duplicator or page printer.

As described above, the image forming apparatus has a simple, easy to maintain structure and clear images can be formed using a one component non-magnetic toner. The method according to the invention includes charging the toner between the member for controlling the amount of toner transported and the conductive support device including an insulating layer. Thus, the electrical field is applied to the toner by the electrical field generating device to transport the toner to the developing device and develop the image.

The amount of electrical charge of the toner may be controlled by controlling the voltage supplied by the electrical field generating device to obtain a clear, high density image without regard to the type of image or change in the environment. Furthermore, using a one component non-magnetic toner, a full color image can be achieved without any problems associated with transferring of the image. Although the developing gap is small, it is possible to form clear images without a special developing electrode effect by making the layer of toner on the toner transporting device thin.

A plurality of members for controlling the amount of toner transported are provided in order to transport a uniform amount of toner. The reliability of the image forming device may also be improved when the member for controlling the amount of toner transported is a rotating body. This also makes it possible to recycle the toner and to prevent the toner from filming.

As described above, the simple structure of the toner transporting device makes it easy to perform the finishing process of the insulating layer. As a result, the developing gap may be set with precision. Since the insulating layer deposited on the thin film conductive support device of the toner transporting device is formed of a resin, a high quality, low cost insulating layer which does not easily deteriorate can be provided. When the insulating layer is formed of photoconductive material, an improved toner transporting device is provided and it is easy to neutralize electrical charges without any deterioration in the image due to waste of electrical charge.

It will thus be seen that the objects as set forth, among those made apparent from the preceding description, are efficiently attained and, since certain changes may be made in carrying out the above method and the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language might be said to fall therebetween.

What is claimed is:

1. An image forming device, comprising:

a latent image bearing means for forming an electrostatic latent image;

at least one toner transporting means adjacent to said latent image bearing means, for transporting a toner to the latent image bearing means, said toner transporting means having a conductive support substrate and an insulating layer deposited on the conductive support substrate selected to block the effect of the charge of the conductive support substrate on the toner;

at least one conductive member adjacent to and spaced from said toner transporting means for controlling the amount of toner transported; and a voltage generating means, said voltage generating means being connected to said conductive member adjacent to said toner transporting means, for forming an electric field between said toner transporting means and said conductive member for charging said toner.

2. The image forming device as claimed in claim 1, and including a plurality of conductive members for controlling the amount of toner transported.

3. The image forming device as claimed in claim 1, wherein at least one conductive member for controlling the amount of toner transported is a rotating body.

4. The image forming device as claimed in claim 1, wherein said conductive member is a blade member.

5. The image forming device as claimed in claim 2, wherein said conductive members including a rotating body and a blade member.

6. The image forming device as claimed in claim 1, and including means for stirring said toner, said means located above said conductive member for controlling the amount of toner transported.

7. The image forming device as claimed in claim 1, and including a means for neutralizing electrical charges on said insulating layer of said toner transporting means after said insulating layer has passed the latent image bearing means.

8. The image forming device as claimed in claim 2, wherein said conductive members for controlling the amount of toner transported are each spaced a predetermined distance from said toner transporting means, said distance narrowing in the direction of displacement of the surface of said toner transporting means.

9. The image forming device as claimed in claim 2, wherein said electric field between each of said conductive members and said toner transporting device varies depending on the position of the conductive member in the path of the surface of said toner transporting device, increasing in the direction of displacement of said toner transporting device.

10. The image forming device as claimed in claim 3, and including at least one member for removing said toner from said rotating conductive member.

11. The image forming device as claimed in claim 1, wherein said toner transporting means is spaced from said latent image bearing means so that said toner on said toner transporting means does not contact said latent image bearing means.

12. The image forming device as claimed in claim 11, wherein said toner transporting means is positioned about 200 $\mu$m or less from said latent image bearing means.

13. The image forming device as claimed in claim 1, wherein said conductive support substrate of said toner transporting means is a cylindrical rotating member.

14. The image forming device as claimed in claim 1, wherein said toner transporting means is an endless belt.

15. The image forming device as claimed in claim 1, wherein said insulating layer on said conductive support substrate of said toner transporting means is a resin.

16. The image forming device as claimed in claim 15, wherein said insulating layer is a resin selected from the group consisting of polyethylene terephthalate, polycarbonate, polysulfon, tetrafluoroethylene, nylon, polystyrene, acrylic, phenol, polyester, silicon elastomer, polyurethane, epoxy resin, polyimide, cellulose or natural rubber.

17. The image forming device as claimed in claim 1, and including a plurality of toner transporting means.

18. The image forming device as claimed in claim 17, wherein each of said toner transporting means transport a different color toner.

19. The image forming device as claimed in claim 18, wherein each of said toner transporting means is selectively positionable into and out of an operative position relative to said latent image bearing means.

20. The image forming device as claimed in claim 13, wherein the ends of said conductive support substrate means are not covered by said insulating layer.

21. The image forming device as claimed in claim 13, wherein said insulating layer covers said conductive support means, said insulating layer being thicker at the ends of said conductive support means to define bearing surfaces in engagement with the latent image bearing means to define a gap between the central region of the insulating layer and the latent image bearing means.

22. The image forming device as claimed in claim 1, wherein said insulating layer on said conductive support means is a photoconductive material.

23. The image forming device as claimed in claim 22, wherein said insulating layer is a photoconductive material selected from the group consisting of selenium, zinc oxide, titanium oxide, cadmium sulfide and an organic photoconductor.

24. The photoconductive image forming device as claimed in claim 1, and including a a one component non-magnetic toner.

25. A toner transporting device for an image forming device, comprising:

a cylindrical conductive support substrate having a cylindrical surface having opposed end regions; and a layer of insulating material deposited on said cylindrical conductive support substrate cylindrical surface, said end regions of said cylindrical support substrate cylindrical surface being free of said insulating material.

26. A toner transporting device for an image forming device, comprising:

a cylindrical conductive support substrate having a cylindrical surface having end opposed regions; and a layer of insulating material deposited on said cylindrical conductive support substrate cylindrical surface, said end regions of said cylindrical support substrate cylindrical surface having a thickened layer of insulating material.

27. An image forming method, comprising:

applying an electric field to a toner across a gap between a conductive support substrate of a toner transporting means and a conductive means for controlling the amount of toner transported by a voltage applying means to charge said toner, said conductive support substrate including an insulating layer for blocking the effect of charge of the support substrate on the toner;

adhering said charged toner to said toner transporting means electrostatically;

transporting said charged toner by said toner transporting means to a position facing and adjacent to a latent image bearing means, said latent image bearing means being adjacent to said toner transporting means;

forming an electrostatic latent image on said latent image bearing means; and developing said electrostatic latent image by transferring said charged toner to the latent image on the latent image bearing means.

28. The method of claim 27, wherein the voltage applying means also applies an electric field for transferring the charged toner, not otherwise in contact with the latent image bearing means, to the latent image bearing means.

29. The method of claim 27, and including the steps of sequentially positioning a toner transporting means associated with each of a plurality of colors in a position facing and adjacent said latent image bearing means.

30. A photoconductive image forming device, comprising:

a latent image bearing means for forming an electrostatic latent image;

at least one toner transporting means adjacent to said latent image bearing means, for transporting a toner to the latent image bearing means, said toner transporting means having a conductive support substrate and an insulating layer deposited on the conductive support substrate;

at least one conductive member adjacent to said toner transporting means for controlling the amount of toner transported;

a voltage generating means, said voltage generating means being connected to said conductive member adjacent to said toner transporting means, for forming an electric field between said toner transporting means and said conductive member; and a means for neutralizing electrical charging on said insulating layer of said toner transporting means after said insulating layer has passed the latent image bearing means.

31. A photoconductive image forming device, comprising:

a latent image bearing means for forming an electrostatic latent image;

at least one toner transporting means adjacent to said latent image bearing means, for transporting a toner to the latent image bearing means, said toner transporting means having a conductive support substrate and an insulating layer deposited on the conductive support substrate, said insulating layer on said conductive support means being a photoconductive material;

at least one conductive member adjacent to said toner transporting means for controlling the amount of toner transported; and a voltage generating means, said voltage generating means being connected to said conductive member adjacent to said toner transporting means, for forming an electric field between said toner transporting means and said conductive member.

32. A photoconductive image forming device, comprising:

a latent image bearing means for forming an electrostatic latent image;

at least one toner transporting means adjacent to said latent image bearing means, for transporting a toner to the latent image bearing means, said toner transporting means having a conductive support substrate and an insulating layer deposited on the conductive support substrate, said insulating layer being a photoconductive material selected from the group consisting of selenium, zinc oxide, titanium oxide, cadmium sulfide and an organic photoconductor;

at least one conductive member adjacent to said toner transporting means for controlling the amount of toner transported; and a voltage generating means, said voltage generating means being connected to said conductive member adjacent to said toner transporting means, for forming an electric field between said toner transporting means and said conductive member.

* * * * *